US005957324A

United States Patent [19]

Gettelman et al.

[11] Patent Number: 5,957,324

[45] Date of Patent: Sep. 28, 1999

[54] TOWEL DISPENSER ADAPTER

[75] Inventors: Alan Gettelman, Burbank; Frank Merriweather, Jr., Carson, both of Calif.

[73] Assignee: Bobrick Washroom Equipment, Inc., North Hollywood, Calif.

[21] Appl. No.: 08/927,056

[22] Filed: Sep. 10, 1997

[51] Int. Cl.[6] ..... A47K 10/24

[52] U.S. Cl. ..... 221/55; 221/312 R

[58] Field of Search ..... 221/33, 45, 55, 221/48, 311, 312 R, 282

[56] References Cited

U.S. PATENT DOCUMENTS

| | | | |
|---|---|---|---|
| 3,028,047 | 4/1962 | Tuft | 221/44 |
| 3,381,852 | 5/1968 | Bastian | 221/44 |
| 3,433,544 | 3/1969 | Monyette et al. | 312/39 |
| 3,597,032 | 8/1971 | Harangozo | 312/39 |
| 5,100,020 | 3/1992 | Petterson et al. | 221/55 |
| 5,848,724 | 12/1998 | Uzzle et al. | 221/312 R |

OTHER PUBLICATIONS

PCT Search Report dated Dec. 21, 1998.

Sketch of San Jamar, Inc's Vision Fold Towel Dispenser, Part No. T1910TBK.

*Primary Examiner*—Kenneth Noland

*Attorney, Agent, or Firm*—Pretty, Schroeder & Poplawski

[57] ABSTRACT

A paper towel dispenser having a housing for supporting a stack of towels and an outlet slot at the bottom of the housing for manual removal of towels one at a time, an adapter positioned within the housing and comprising a single sheet of material having a spacer section and a flange section joined by a hinge section, with the spacer section being positionable adjacent an inner wall of the housing and the flange section being positionable on the bottom of the housing adjacent the outlet slot, with the housing and adapter flange section having interengaging guide means for locating the adapter at at least two positions on the housing bottom for selectively spacing the lower end of the adapter spacer section at at least two distances from the housing inner wall.

6 Claims, 4 Drawing Sheets

TOWEL DISPENSER ADAPTER

BACKGROUND OF THE INVENTION

This invention relates to paper towel dispensers of the type having a housing for receiving a stack of towels, and an outlet slot at the bottom of the housing for manually removing towels one at a time. Typically, the towels are C folded or Z folded in a stack of a standard width and standard height, and of a depth, that is the distance from front to back of the stack, also of a predetermined size. Typically, the housing is mounted on a wall of a washroom or the like, and has a hinge at the bottom which permits opening the housing for inserting a new stack of towels.

In the past, the practice has been to produce the housing for handling a single size of towel. If the customer is going to use the larger size, a larger size housing will be provided and if the customer is going to use the smaller size, a smaller size housing will be provided. Hence, if a customer wishes to change the size of towel, the housing itself must be changed. At the present time, there is a trend to using the smaller size towel in order to reduce costs, but a customer currently using the larger size towel is reluctant to incur the additional cost of changing housings.

Accordingly, it is an object of the present invention to provide a new and improved paper towel dispenser construction which can easily adapt a housing to either of two desired sizes, or actually to any size within a range of large to small.

It is a particular object of the invention to provide a new adapter for inserting into a conventional paper towel dispenser which adapter is readily installed in existing dispensers and which is readily adjusted over a range of towel sizes by simply loosening and tightening one or more screws.

Other objects, advantages, features and results will more fully appear in the course of the following description.

SUMMARY OF THE INVENTION

A paper towel dispenser for handling stacks of paper towels of two different sizes.

An adapter for a paper towel dispenser having a housing for supporting a stack of towels and an outlet slot at the bottom of the housing for manual removal of towels one at a time, the adapter being positionable in the housing and comprising a single sheet of material having a spacer section and a flange section joined by a hinge section, with the spacer section being positionable adjacent to an inner wall of the housing and the flange section being positionable on the bottom of the housing adjacent the outlet slot, with the adapter flange section having guide means for locating the adapter at at least two positions on the housing bottom for selectively spacing the lower end of the adapter section at at least two distances from the housing inner wall.

A paper towel dispenser having a housing for supporting a stack of towels and an outlet slot at the bottom of said housing for manual removal of towels one at a time, an adapter positioned within the housing and comprising a single sheet of material having a spacer section and a flange section joined by a hinge section, the spacer section being positionable adjacent to an inner wall of the housing and the flange section being positionable on the bottom of the housing adjacent the outlet slot, the housing and adapter flange section having interengaging guide means for locating the adapter at at least two positions on the housing bottom for selectively spacing the lower end of the adapter spacer section at at least two distances from the housing inner wall, and including interengaging connection means for maintaining the adapter at the selected distance from the housing inner wall.

DESCRIPTION OF THE PREFERRED EMBODIMENT

Figure 1:
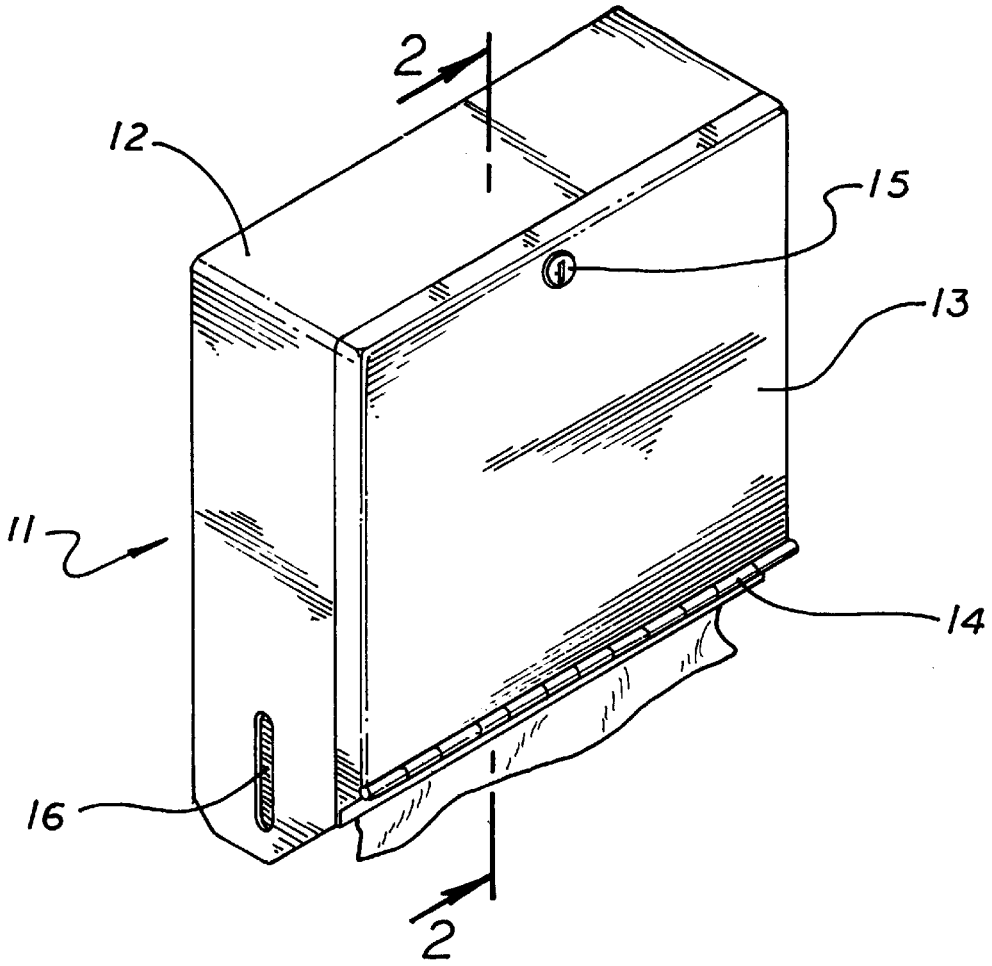
FIG. 1 is a perspective view of a paper towel dispenser incorporating the adapter of the invention.
Figure 3:
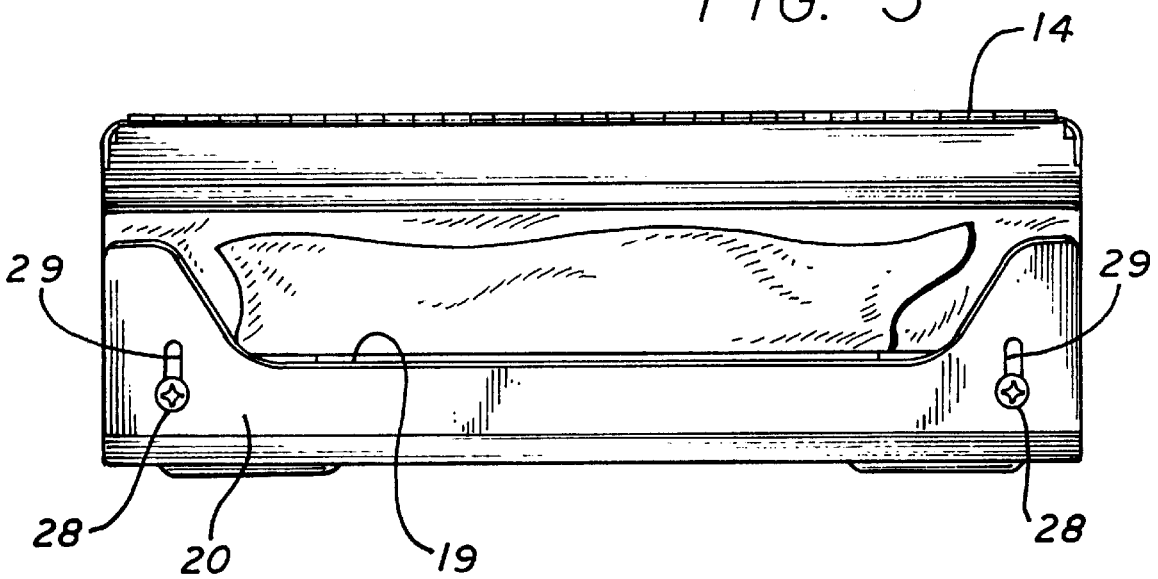
FIG. 3 is an enlarged bottom view of the dispenser of FIG. 2A.

A paper towel dispenser 11 is shown in FIG. 1, with a housing 12 and a cover 13. The cover is joined to the housing at a hinge 14 permitting the cover to move forward, providing access to the interior of the housing for inserting a stack of paper towels. A catch or lock 15 is positioned in the cover at the upper edge for latching the cover to the housing in the closed position as seen in FIG. 1. A viewing slot 16 is provided in at least one end of the housing for indicating the amount of towels remaining in the housing.

An outlet slot 19 is provided in the bottom 20 of the housing, for withdrawing the paper towels one at a time. Typically the stack of towels are C-folded or Z-folded, and the edge of the bottom towel of the stack is fed out through the outlet slot when a new stack is placed in the housing. Then the user grasps the exposed edge of the towel and pulls downward to obtain one towel for use.

Figure 4:
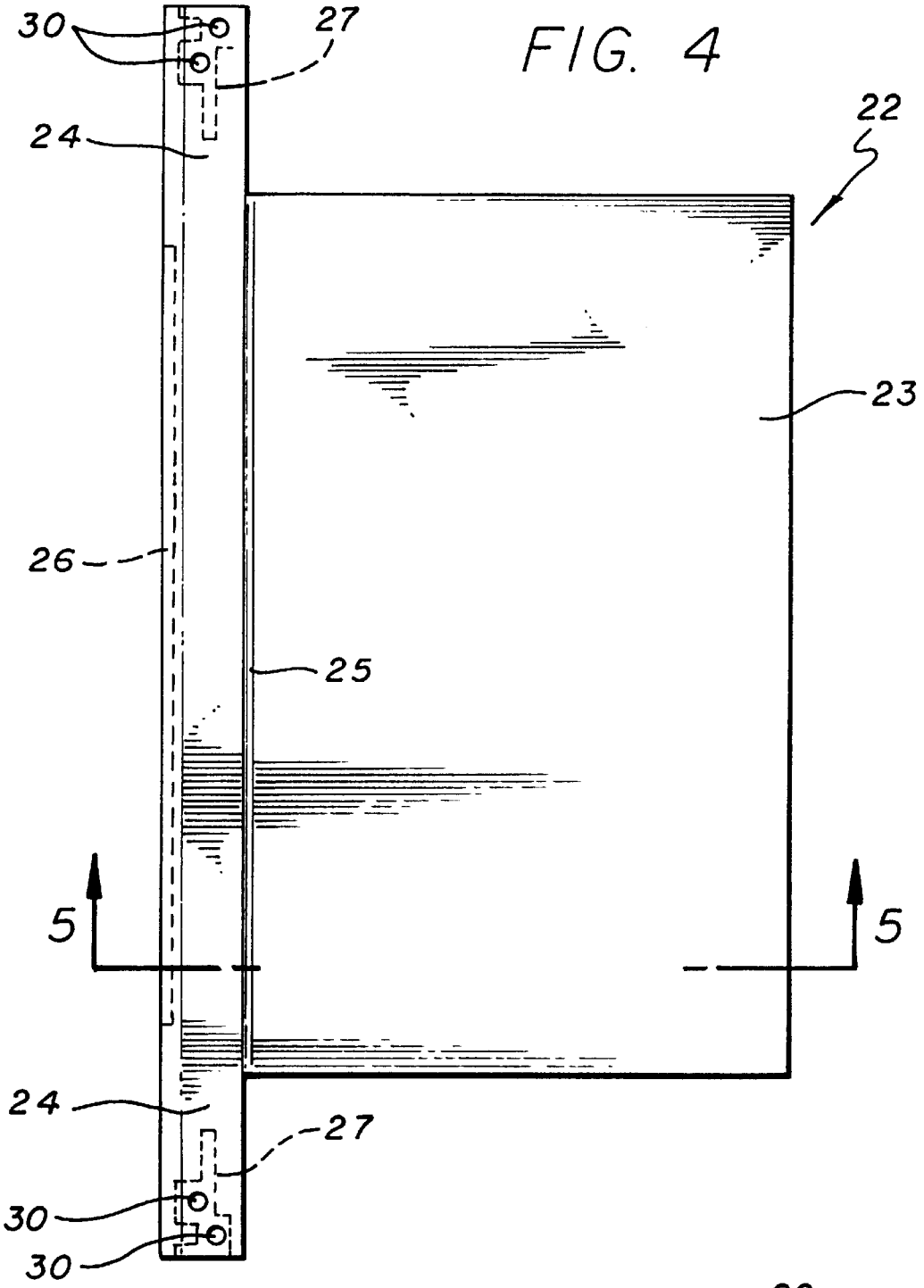
FIG. 4 is a plan view of the adapter used in FIGS. 1–3.
Figure 5:
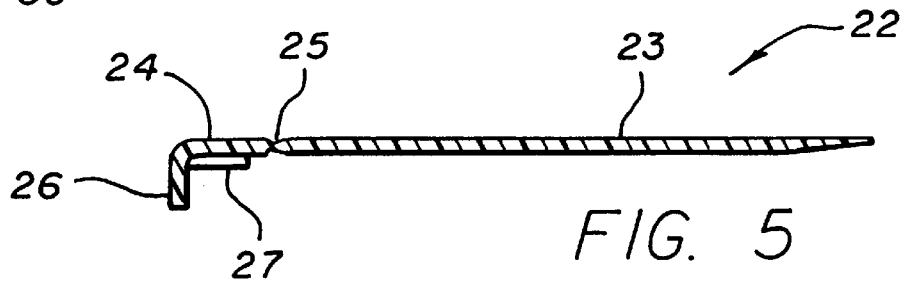
FIG. 5 is a sectional view taken along the line 5—5 of FIG. 4.

An adapter 22 having a spacer section 23 and a flange section 24 joined by hinge section 25 is shown in FIGS. 4 and 5. Preferably the outer edge 26 of the flange section 24 is turned downward for projecting outward through the outlet slot 19. Also preferably, a thicker section 27 is provided on the slant section 24, as best seen in FIGS. 5 and 6, to provide material for the holding screw thread.

Figure 2:
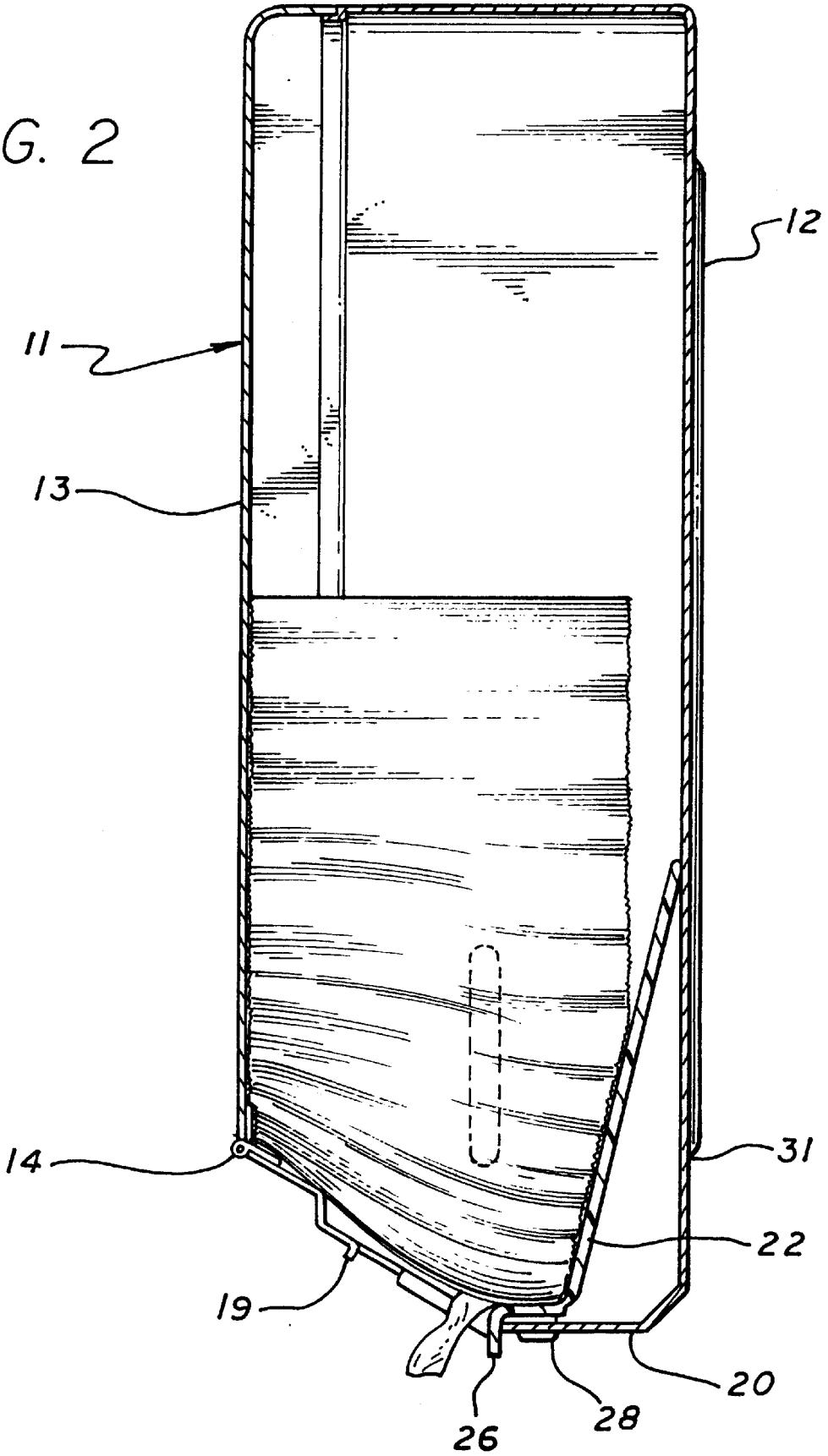
FIG. 2 is an enlarged sectional view taken along the line 2—2 of FIG. 1 showing the dispenser with the adapter installed in the forward or out position for handling a stack of towels of the smaller depth.
Figure 2A:
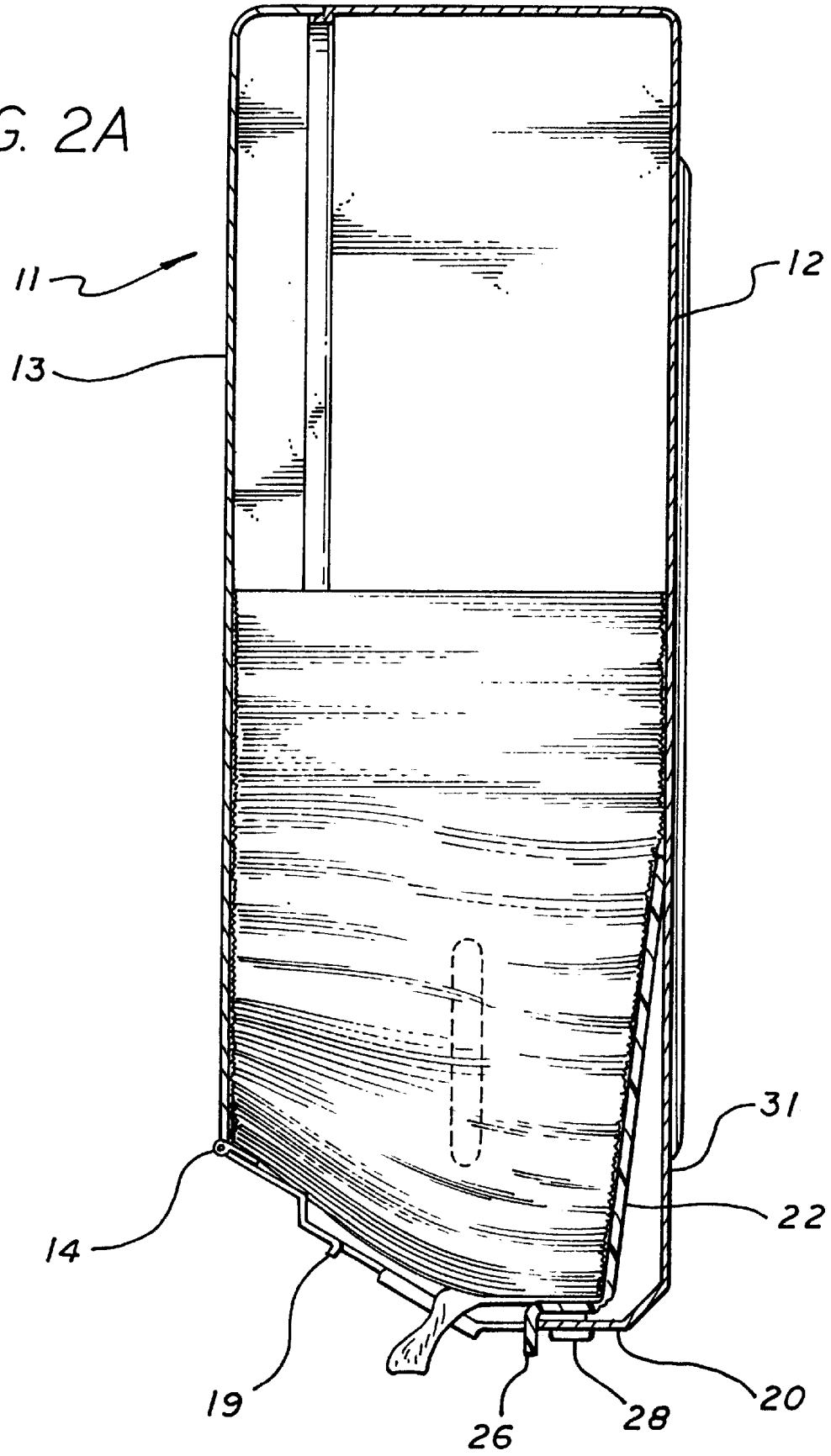
FIG. 2A is a view similar to that of FIG. 2 showing the adapter in the rearward or in position for handling a stack of towels of the larger depth.

The adapter 22 is mounted within the housing 12, as best seen in FIGS. 2 and 2A. The adapter is attached to the housing bottom 20 by screws 28 which pass through guide slots 29 in the bottom 20 and are threaded into corresponding openings 30 in the flange section 24 of the adapter. With this construction, the adapter may be positioned in the housing with various spacings between the back 30 of the housing. The openings 31 are provided in two different positions to fit in dispensers with different towel widths. With this arrangement, the dispenser can be adjusted to handle towels of a lesser depth from front to back, as shown in FIG. 2, and towels of a greater depth from front to back as shown in FIG. 2A.

With this construction, a single paper towel dispenser can be manufactured, stocked and installed, and be readily adaptable for use with different sizes of towels. This unique construction permits the operator to choose different towel configurations depending upon needs of the users and upon availability of towels. It also permits the operator to change all the units in a building from one size to another by merely adjusting the position of the adapter.

Another advantage of this new construction is that the adaptor moves the entire stack of lesser depth towels forward in the dispenser. This position allows for better dispensing because the towels are positioned in the opening better than in prior designs which do not center the towels over the outlet opening.

We claim:

1. An adapter for a paper towel dispenser having a housing for supporting a stack of towels and an outlet slot at the bottom of the housing for manual removal of towels one at a time, said adapter being positionable in said housing and comprising a single sheet of material having a spacer section and a flange section joined by a hinge section, said spacer section being positionable adjacent an inner wall of the housing and said flange section being positionable on the bottom of the housing adjacent the outlet slot, said adapter flange section having guide means for locating said adapter at at least two positions on the housing bottom for selectively spacing the lower end of said adapter section at at least two distances from the housing inner wall.

2. An adapter as defined in claim 1 wherein said flange section guide means includes means defining a screw opening for receiving a screw positioned in a slot in the housing bottom.

3. An adapter as defined in claim 2 including a lip at said flange section projecting downward into the bottom outlet slot.

4. A paper towel dispenser having a housing for supporting a stack of towels and an outlet slot at the bottom of said housing for manual removal of towels one at a time, an adapter positioned within said housing and comprising a single sheet of material having a spacer section and a flange section joined by a hinge section, said spacer section being positionable adjacent an inner wall of said housing and said flange section being positionable on the bottom of said housing adjacent said outlet slot, said housing and adapter flange section having interengaging guide means for locating said adapter at at least two positions on said housing bottom for selectively spacing the lower end of said adapter spacer section at at least two distances from said housing inner wall, and including interengaging connection means for maintaining said adapter at the selected distance from said housing inner wall.

5. A paper towel dispenser as defined in claim 4 wherein said guide means includes means defining a screw opening in said adapter flange section, a guide slot in the housing bottom, and a screw positioned in said slot and said screw opening for clamping said adapter to said housing.

6. A paper towel dispenser as defined in claim 5 including a down turned lip at said flange section and projecting downward into the bottom outlet slot.

* * * * *